US007581735B2

(12) United States Patent
Birdsell et al.

(10) Patent No.: US 7,581,735 B2
(45) Date of Patent: Sep. 1, 2009

(54) SKATEBOARD SKI WITH SPRING SUSPENSION

(76) Inventors: Brad Birdsell, 3138 W. Monte Cristo Ave., Phoenix, AZ (US) 85053; Eric Raymond Hansen, 1113 W. Kathleen, Phoenix, AZ (US) 85023; David M. Shipley, 7032 W. Columbine Dr., Peoria, AZ (US) 85381

( * ) Notice: Subject to any disclaimer, the term of this patent is extended or adjusted under 35 U.S.C. 154(b) by 529 days.

(21) Appl. No.: 11/291,162

(22) Filed: Nov. 30, 2005

(65) Prior Publication Data

US 2007/0120335 A1 May 31, 2007

(51) Int. Cl.
*B62B 19/04* (2006.01)

(52) U.S. Cl. ..... 280/14.21; 280/14.25; 280/14.26; 280/87.042; 280/7.14

(58) Field of Classification Search ..... 280/87.01, 280/87.021, 87.03, 87.041, 87.042, 14.26, 280/14.25, 9, 11.14, 14.21
See application file for complete search history.

(56) References Cited

U.S. PATENT DOCUMENTS 3,203,706 A * 8/1965 Boyden ..... 280/7.12
3,391,947 A * 7/1968 Hodas ..... 280/87.03
3,583,722 A * 6/1971 Jacobson ..... 280/16
4,114,913 A * 9/1978 Newell et al. ..... 280/14.21
4,116,455 A * 9/1978 Dotson et al. ..... 280/7.12
4,165,091 A * 8/1979 Chadwick ..... 280/14.21
4,244,593 A * 1/1981 Malone ..... 280/8
4,521,029 A * 6/1985 Mayes ..... 280/7.14
4,896,893 A * 1/1990 Shumays et al. ..... 280/14.21
5,114,166 A * 5/1992 McCosker ..... 280/87.042
5,161,810 A * 11/1992 DeCesare ..... 280/14.21
5,249,816 A * 10/1993 Southworth ..... 280/14.25
5,984,328 A * 11/1999 Tipton ..... 280/87.042
6,311,990 B1 * 11/2001 Landry ..... 280/14.26
6,616,155 B2 * 9/2003 Tuan ..... 280/87.041
6,619,674 B2 * 9/2003 Baldwin ..... 280/14.25
7,040,634 B1 * 5/2006 Elkins, Jr. ..... 280/14.25
2002/0043775 A1 * 4/2002 Baldwin ..... 280/14.21
2002/0050693 A1 * 5/2002 Link ..... 280/14.25

(Continued)

*Primary Examiner*—Christopher P Ellis
*Assistant Examiner*—Katy Meyer
(74) *Attorney, Agent, or Firm*—Gregory J. Nelson

(57) ABSTRACT

A skateboard/ski combination wherein the four wheels of a traditional skateboard have been removed, while the skateboard trucks remain in place, and are then replaced with four ski apparatuses. An anchoring plate connects springs from the underside of the skateboard deck to the ski apparatus base that maintains a traditional ski shape, with rails that protrude outward from the front and rear of the ski base, still maintaining a traditional ski shovel shape. The ski base, which has a flat or concave surface perpendicular to the length of the ski, contains a radius positioned longitudinally to the ski length (rocker) that then transitions to a small radius at the front and rear of the skis, thereby providing a traditional ski shovel in the front and rear of the ski base. Metal or plastic rails are mounted to the ski base on opposing sides of the base in a vertical fashion, extending below the surface of the base. The rails have a radius positioned longitudinally to the ski length (rocker) that transitions to a small radius at both the front and rear ends of the base. An alternative spring suspension system uses torsion springs located in the vicinity of the axle hole on the skateboard truck. This combination allows the user to perform traditional skateboard maneuvers on snow.

12 Claims, 12 Drawing Sheets

U.S. PATENT DOCUMENTS

2005/0012282 A1* 1/2005 Woodruff ..... 280/7.14
2005/0212226 A1* 9/2005 Landry ..... 280/7.14
2007/0257460 A1* 11/2007 Tsuchie ..... 280/87.042

* cited by examiner

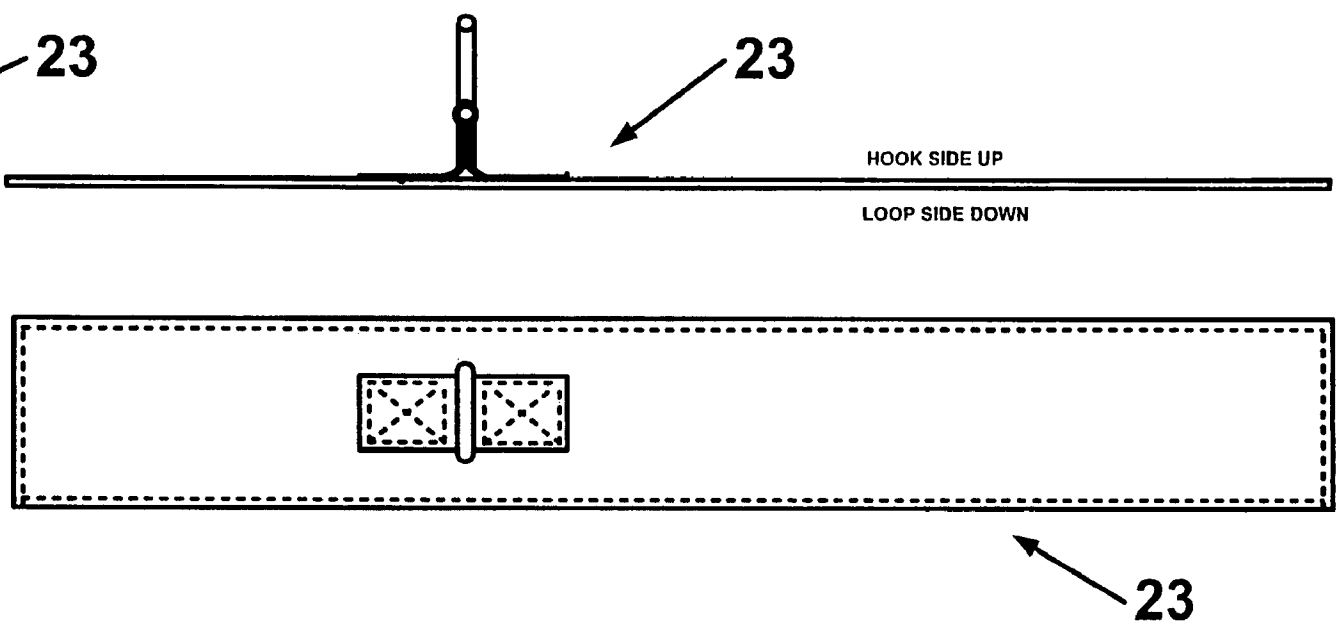
FIG. 12A
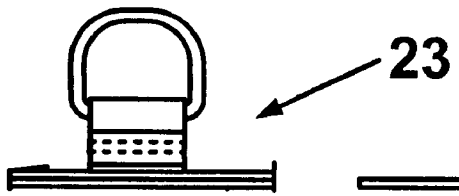
FIG. 12B
FIG. 12

SKATEBOARD SKI WITH SPRING SUSPENSION

PRIOR APPLICATION

Not Applicable.

FIELD OF THE INVENTION

This invention relates to the field of skateboards and snow skis/snowboards, in particular, the instant invention involves a traditional skateboard that has been transformed into a skiing device that can perform skateboard maneuvers on snow.

BACKGROUND OF THE INVENTION

In the area of skateboarding, skateboarders have traditionally had to turn to snowboards to have similar recreation in the snowy weather. Snowboarding, however, varies in many significant ways from skateboarding. The most obvious difference is the fact that a snowboarder's feet are bound and attached through boots to the snowboard, whereas, on a skateboard, the rider's feet are merely placed on top of the deck of the skateboard and are easily freed from the board to perform tricks and to discontinue the use of the board. Another significant difference is the feel and handling of the snowboard compared to a skateboard due to the fact that the skateboard has wheels and a truck between the deck and the ground that allows for steering and control while a snowboard's deck comes in direct contact with the ground. The locked-in feet and lack of suspension/steering ability make snowboarding a related, but different skill than skateboarding. Another feature of snowboarding and skiing is that both are edging devices. The instant invention, on the other hand, provides a turning/steering ability rather than an edging ability.

There have been devices known in the prior art that purport to combine skateboarding and snow recreation. However, none of the previous inventions have been able to offer the same suspension/steering or truck turning ability found on skateboards that are required to perform skateboard tricks. Chou in U.S. Pat. No. 6,481,725 teaches of a skateboard that attaches to one traditional ski. This invention does not have any spring suspension/steering ability, however. Differing from the instant invention, this device involves a single ski with no independent truck-turning ability. Similarly, Dotson in U.S. Pat. No. 4,116,455 involves a skateboard platform combined with removable ski shoes. No spring suspension/steering ability is included in this invention and therefore, most, if not all, skateboard tricks are not achievable on this device. This invention defines a board with only two skis, therefore there is no independent suspension and the define ski does not have the rocker provided in the instant invention.

Hirbod in U.S. Pat. No. 4,181,319 discloses a self-propelled skateboard with improved suspension capabilities. However, this invention is very complex, contains footpads and mechanisms for use with the hands. Therefore, a need exists for a simple skateboard/ski combination, without foot bindings, that can be used on snow and that has the same suspension/steering abilities that a skateboard does on pavement.

SUMMARY OF THE INVENTION

In the preferred embodiment of the invention, a skateboard/ski combination is described. A traditional skateboard deck has its wheels removed. The skateboard trucks remain in place, however. The four wheels on the traditional skateboard truck are replaced with four skis. The apparatus contains a spring suspension/steering system providing a neutral location of the skis at rest that rebounds to a neutral location when the skis are excited by external force.

The spring suspension/steering system includes two anchoring plates that are mounted between the underside of the skateboard deck and the trucks. The anchoring plates are hooked to a plurality of extension springs either through holes or prongs. Each ski has two extension springs connected between the ski and the anchor plate. The anchor plate helps create a tool-less ability to pre-load the skis for desired ride and functionality. The skis can be pre-loaded in either direction by disconnecting one spring per ski, be it the inboard or outboard springs, to achieve the desired performance enhancements.

The skis are composed of a base made of either plastic or metal that has a traditional ski shape, i.e., providing a ski shovel at both the front and rear ends of said base. The ski base, which has a flat or concave surface perpendicular to the length of the ski, contains a radius positioned longitudinally to the ski length (rocker) that then transitions to a small radius at the front and rear of the skis. This provides a traditional ski shovel in the front and rear of the ski base. Metal or plastic rails are mounted to the ski base on opposing sides of the base in a vertical fashion, extending below the surface of the base. The rails have a radius positioned longitudinally to the ski length (rocker) that transitions to a small radius at both the front and rear ends of the base. These rails are interchangeable to achieve different types of performance characteristics and to quickly and easily repair or replace worn or damaged rails.

In an alternative embodiment of the invention, the spring suspension/steering system is comprised of a torsion spring mounted inside of the vertical portion of the skateboard/ski combination in the vicinity of the hole of the axle. The torsion springs act against the axle and the ski base to provide a neutral suspended location and spring tension when he ski is rotated about the axle in either a clockwise or counterclockwise direction.

Another alternative embodiment of the invention involves the addition of a multi-purpose leash 24 and cuff assembly 23 that attaches the board to the rider that is added for safety and utility.

OBJECT OF THE INVENTION

The principal object of the invention is to replace the wheels on a traditional skateboard with skis. This allows the skateboard rider to ride on snow with the same agility as the traditional wheeled skateboard on pavement. The rider will be able to perform all the same tricks and maneuvers as on a non-snowy surface. Skateboarders, snowboarders and anyone interesting in trying new sports will find this invention useful.

BRIEF DESCRIPTION OF THE DRAWINGS

FIG. 12 is a top view of a cuff attachable to a rider of the skateboard/ski combination of the present invention;

FIG. 12A is a side view of the cuff of FIG. 12 of the skateboard/ski combination of the present invention;

FIG. 12B is a front view of the cuff of FIG. 12 of the skateboard/ski combination of the present invention.

DETAILED DESCRIPTION OF AN ENABLING AND PREFERRED EMBODIMENT

Figure 1:
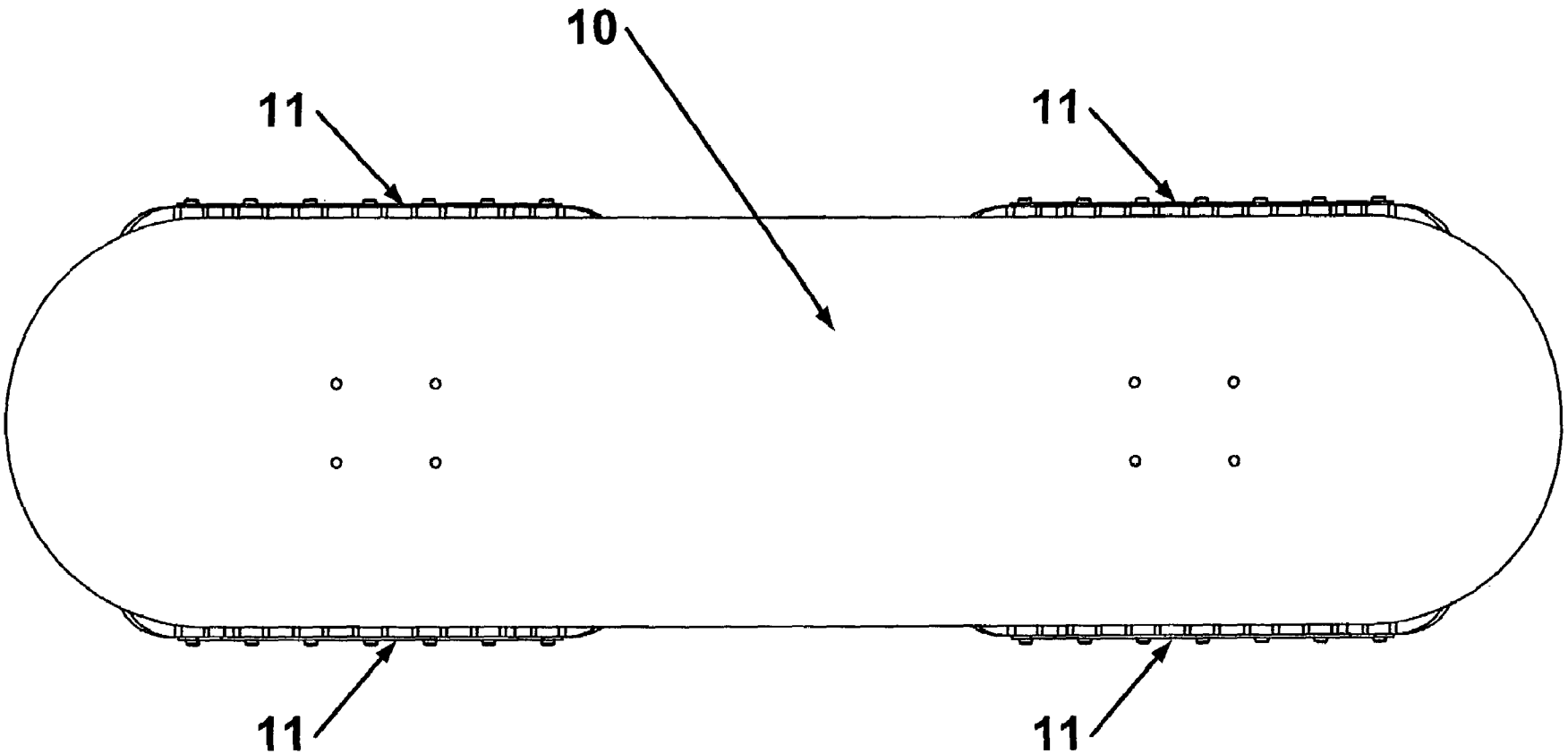
FIG. 1 illustrates a top view of the skateboard/ski combination of the present invention.
Figure 2:
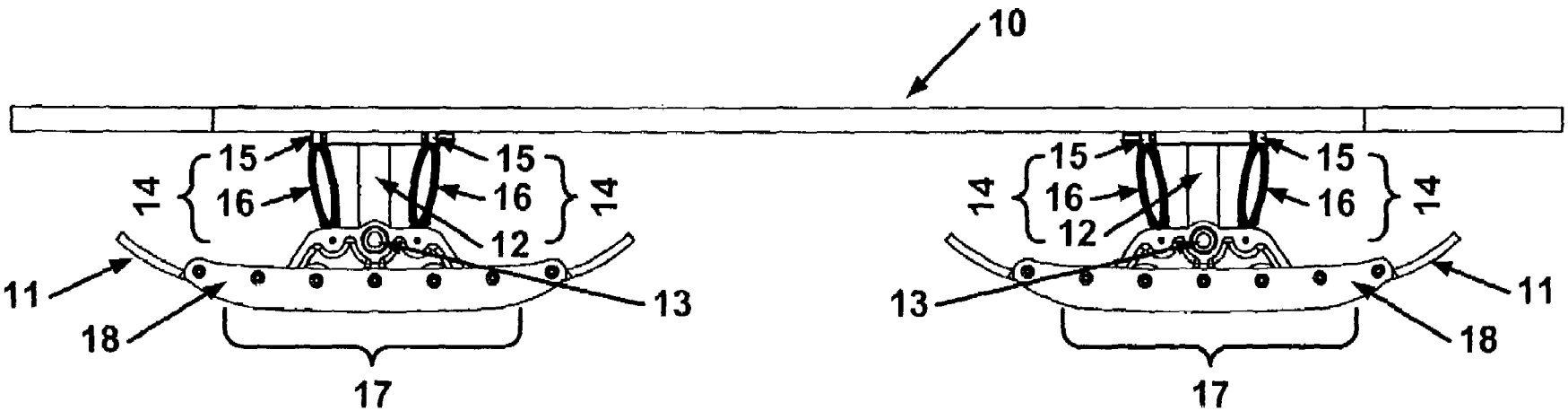
FIG. 2 illustrates a side view of the skateboard/ski combination of the present invention.
Figure 3:
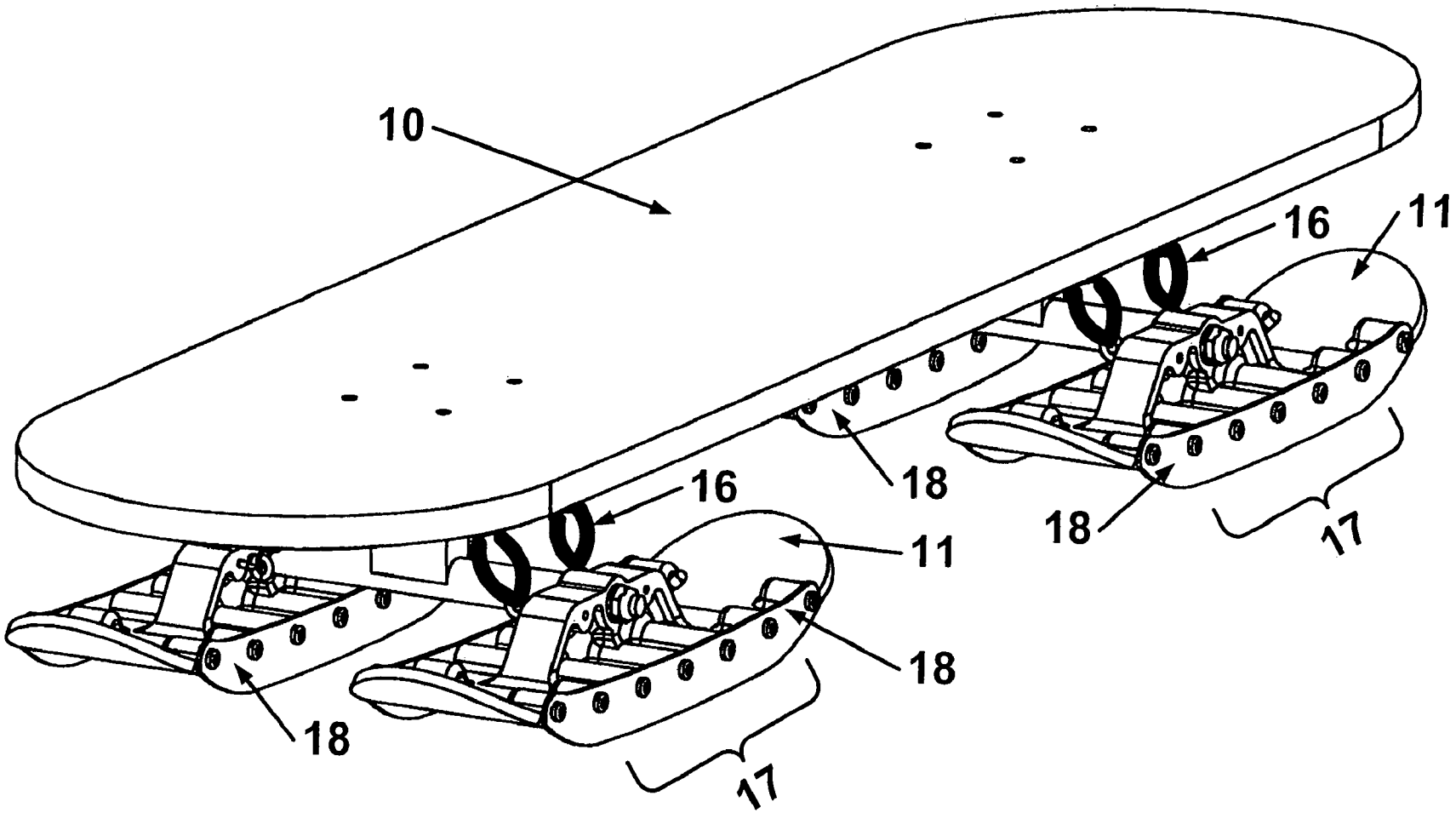
FIG. 3 illustrates a perspective view of the skateboard/ski combination of the present invention.
Figure 4:
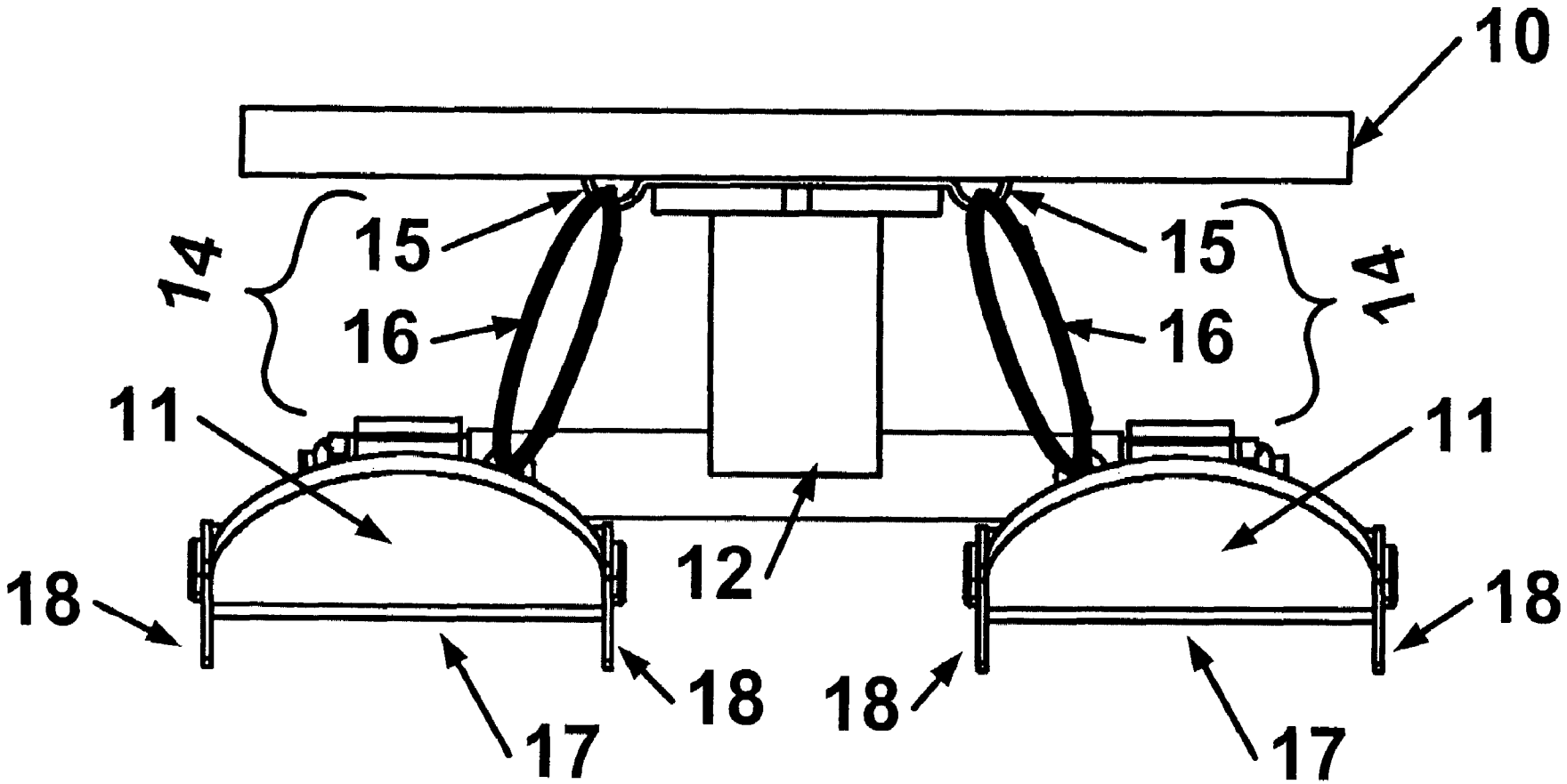
FIG. 4 illustrates an end view of the skateboard/ski combination of the present invention.
Figure 5:
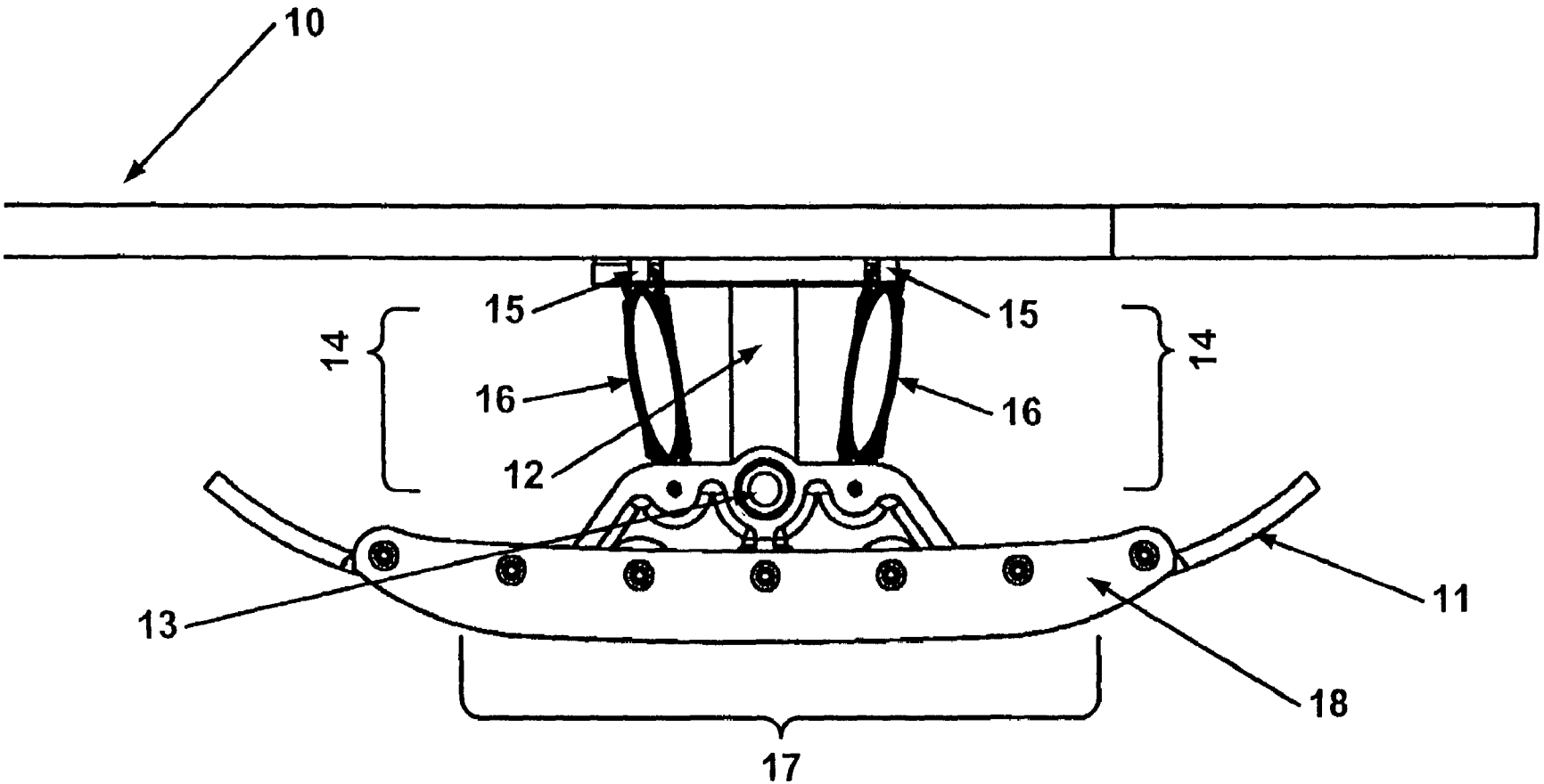
FIG. 5 is a side view of a ski of the skateboard/ski combination of the present invention.
Figure 6:
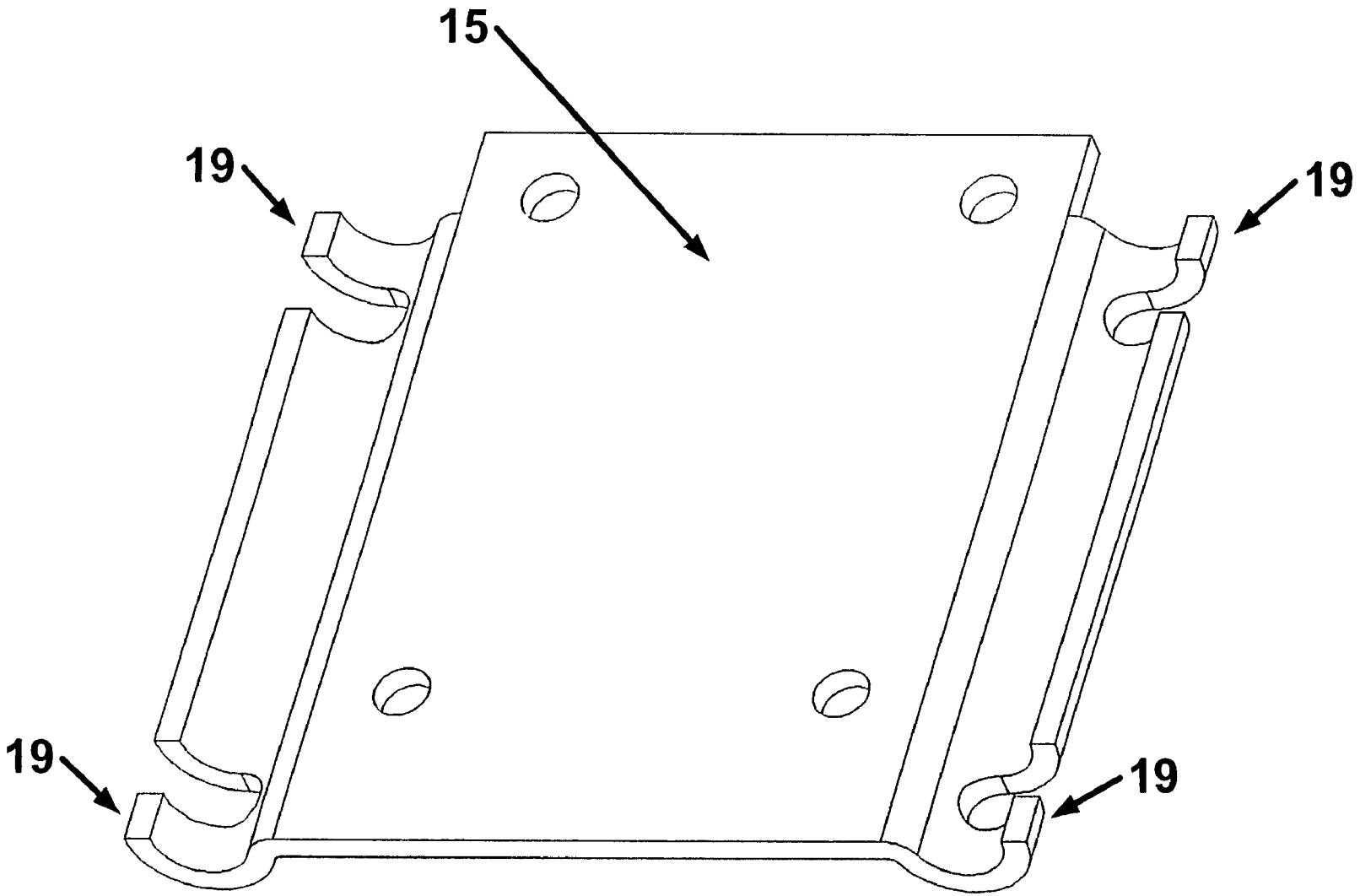
FIG. 6 is a perspective view of the anchor plate of the component of the skateboard/ski combination of the present invention.
Figure 7:
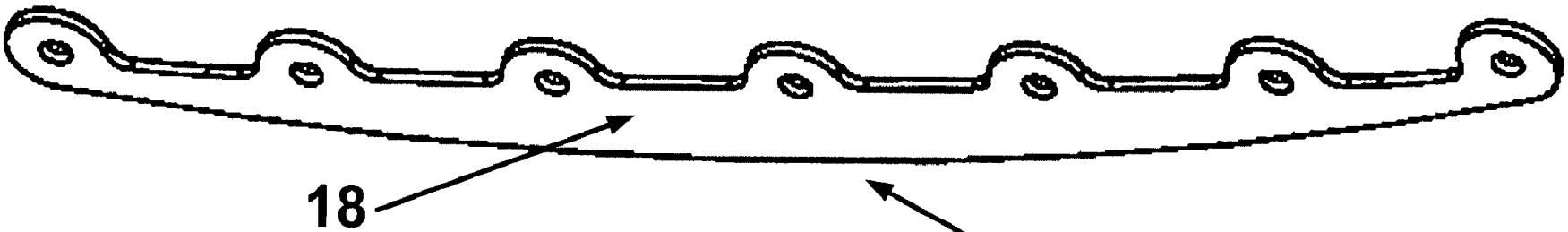
FIG. 7 is a perspective view of the rail of the skateboard/ski combination of the present invention.
Figure 9:
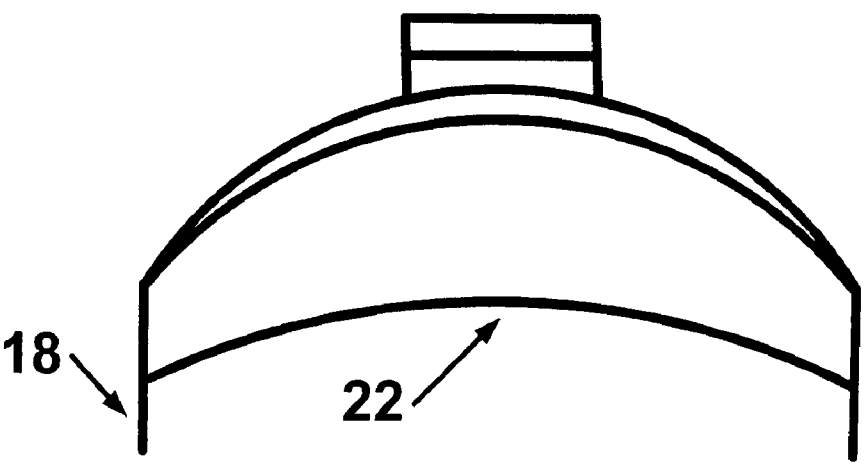
FIG. 9 is a cross-sectional view of a ski having a concave base of the skateboard/ski combination of the present invention.
Figure 8:
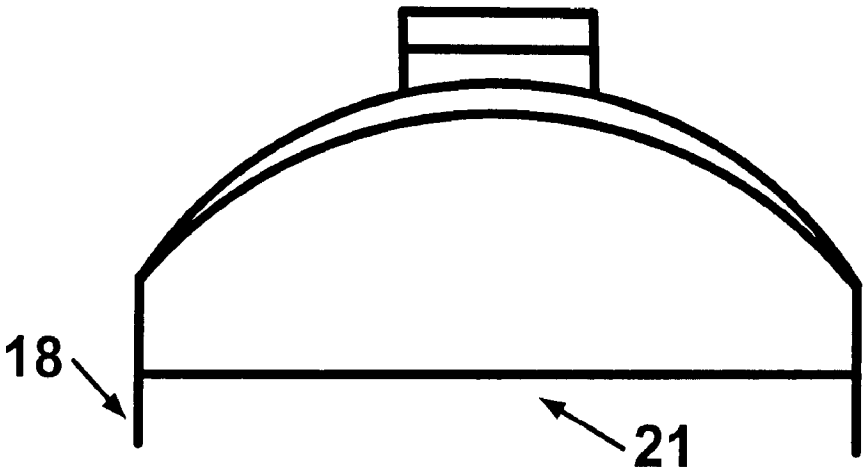
FIG. 8 is a cross-sectional view of a ski having a flat base of the skateboard/ski combination of the present invention.
Figure 10:
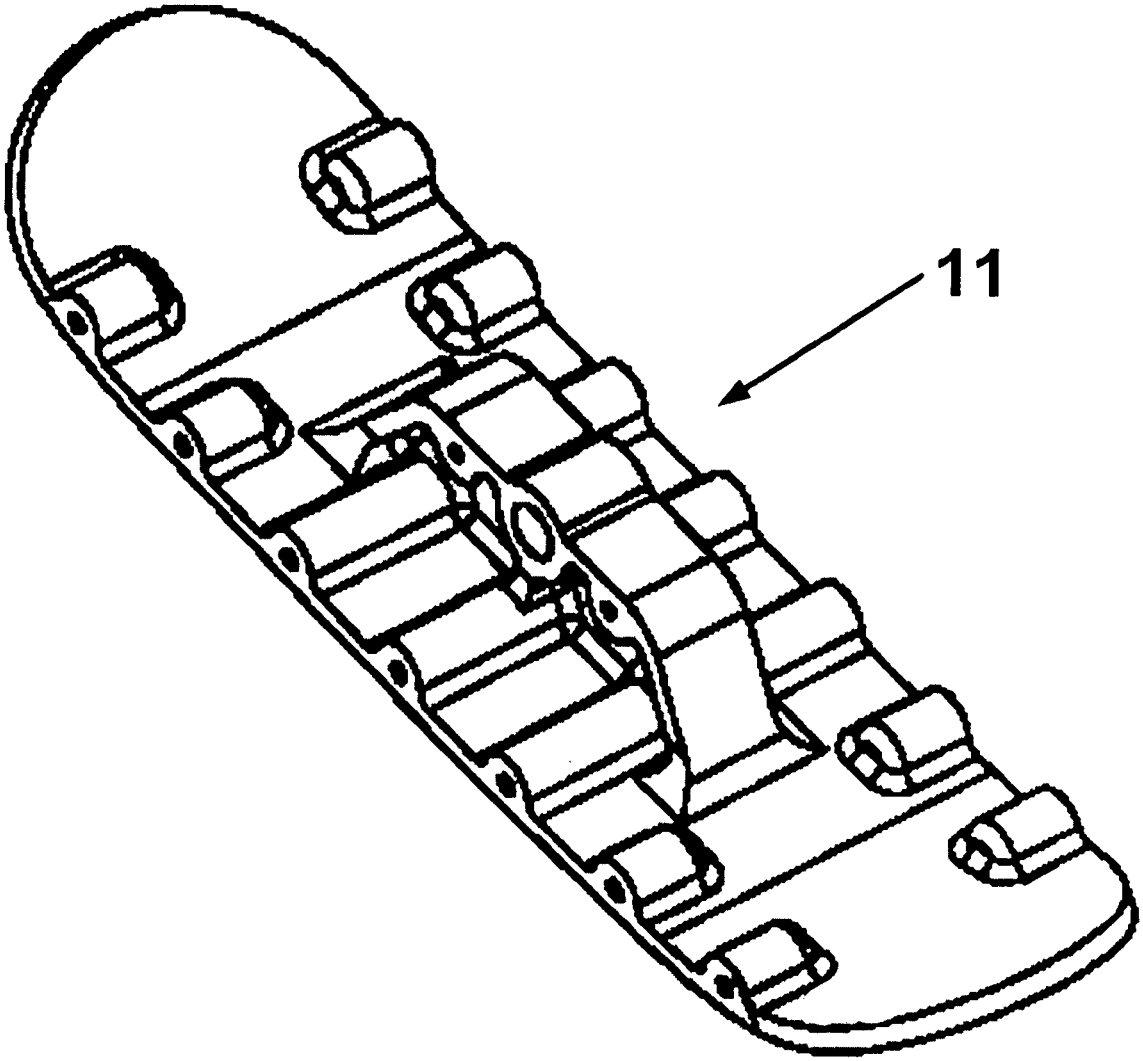
FIG. 10 is a perspective view of a ski with rails detached of the skateboard/ski combination of the present invention.
Figure 11:
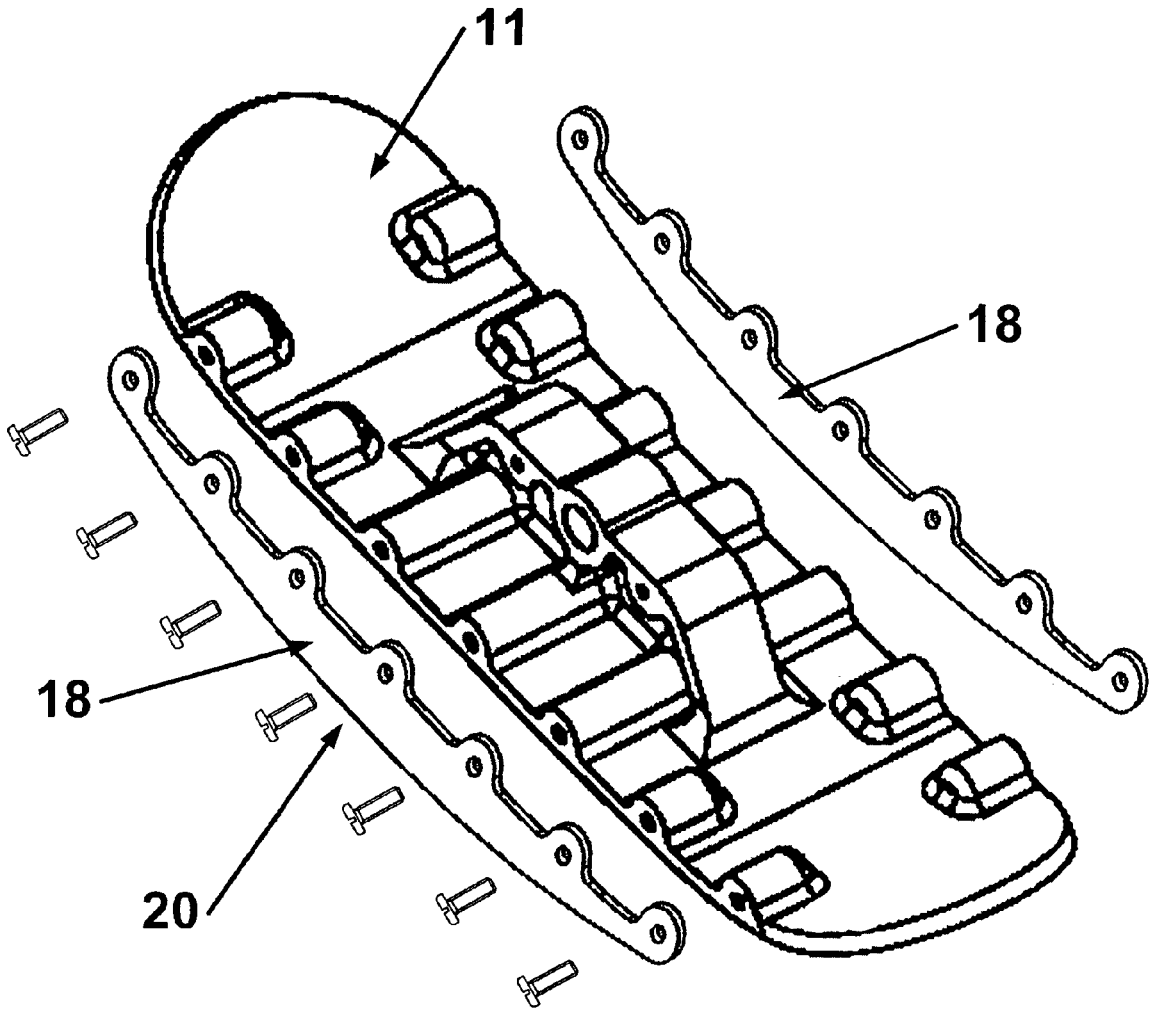
FIG. 11 is an exploded perspective view of a ski and rail assembly of the skateboard/ski combination of the present invention
Figure 13:
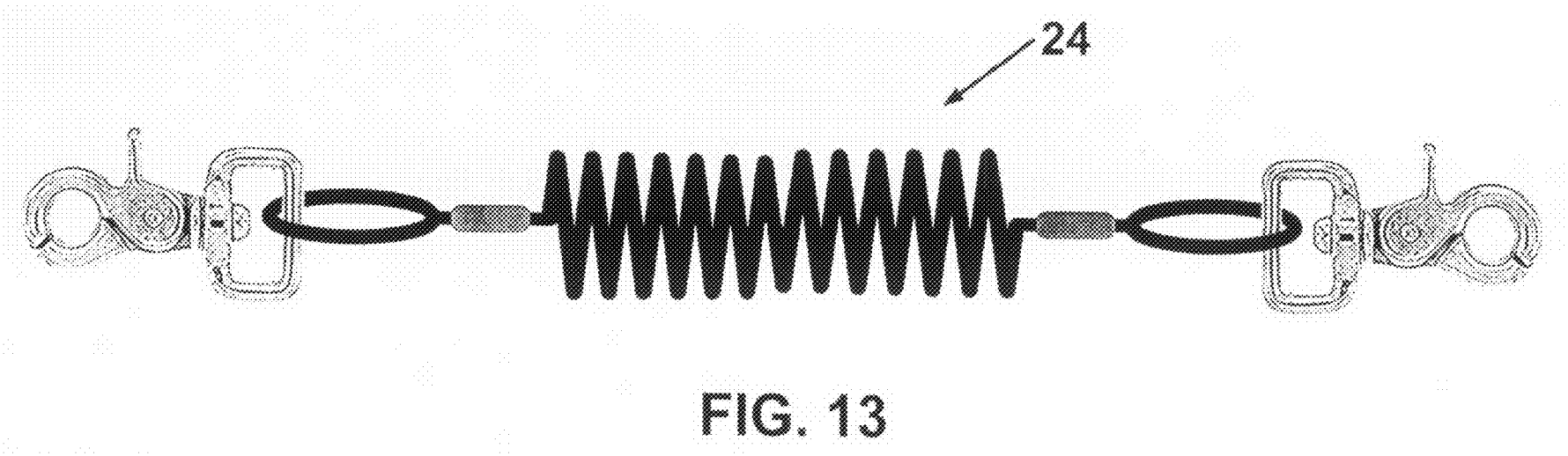
FIG. 13 is a view of the leash.

For a better understanding of the invention, we turn now to the drawings. FIG. 1 offers a top view of the skateboard deck 10 with the skis 11 somewhat obscured underneath. The skis 11 are more readily seen in FIGS. 2-4. The skateboard deck 10 has its wheels removed, while the trucks 12 remain in place. The invention includes a spring suspension/steering system 14 providing a neutral location of the skis at rest that rebounds to a neutral location when the skis are excited by external force.

The spring suspension/steering system 14 includes two anchoring plates 15 that are mounted between the underside of the skateboard deck 10 and the trucks 12. The anchoring plates 15 are hooked to a plurality of extension springs 16 either through holes or prongs 19. Each ski 11 has two extension springs 16 connected between the ski 11 and the anchoring plate 15.

The skis 11 are composed of a base 17 made of either plastic or metal that has a traditional ski shape, i.e., providing a ski shovel at both the front and rear ends of the base 17. The ski base 17, which has a flat surface 21 or concave surface 22 perpendicular to the length of the ski 11, contains a radius positioned longitudinally to the ski length (rocker 20) that then transitions to a small radius at the front and rear of the skis 11. This provides a traditional ski shovel in the front and rear of the ski base 17. Metal or plastic rails 18 are mounted to the ski base 17 on opposing sides of the base in a vertical fashion, extending below the surface of the base 17. The rails 18 have a radius positioned longitudinally to the ski length (rocker) that transitions to a small radius at both the front and rear ends of base 17. These rails are interchangeable to achieve different types of performance characteristics and to quickly and easily repair or replace worn or damaged rails.

In an alternative embodiment of the invention, the spring suspension/steering system is comprised of a torsion spring (not shown) mounted inside of the vertical portion 13 of the skateboard/ski combination in the vicinity of the hole of the axle 13. The torsion springs act against the axle 13 and the ski base 17 to provide a neutral suspended location of the skis and spring tension when the ski 11 is rotated about the axle 13 in either a clockwise or counterclockwise direction.

The illustrations and examples provided herein explanatory purposes and are not intended to limit the scope of the appended claims, as those skilled in the art will make modifications to the invention for particular uses.

We claim:

1. A skateboard/ski combination comprising:

(a) a skateboard deck having upper and lower surfaces and opposite front and rear ends;

(b) a front truck mounted on the lower surface of the deck disposed toward the front and a rear truck mounted on the lower surface of the deck disposed toward the rear, each said truck having a body supporting a transversely extending axle having opposite ends;

(c) an anchor plate interposed between the lower surface of the deck and each of said trucks, each said anchor plate having opposite sides with connectors on opposite sides of the plate;

(d) a ski pivotally coupled to the ends of each of said axles, said skis each having a length, inboard and outboard sides, a base and opposite ends, said skis being continuously curved along their length having a rocker with a first larger radius of curvature along its length intermediate the ends and transitioning at the opposite ends to curved shovels each having a second radius of curvature smaller than the first radius of curvature;

(e) rails extending along the opposite sides of said skis, each rail projecting below the associated ski base, said rails being detachable from said skis; and (f) detachable extension springs extendable between the connectors on the anchor plates and the inboard sides of the associated ski whereby the rider can selectively attach springs between the anchor plates and the skis to apply tension to the skis to selectively adjust performance characteristics of the skateboard/ski combination without the use of tools.

2. A skateboard/ski combination according to claim 1 where said connectors comprise holes in said plate.

3. A skateboard/ski combination according to claim 1 wherein said connectors comprise prongs on said plate.

4. A skateboard/ski combination according to claim 1 wherein said rails are made of metal.

5. A skateboard/ski combination according the claim 1 wherein said rails are made of plastic.

6. A skateboard/ski combination according to claim 1 wherein said base surface is flat.

7. A skateboard/ski combination according to claim 1 wherein said base surface is transversely concave.

8. A skateboard/ski combination according to claim 1 wherein said rails are interchangeable in order to adjust performance and to quickly and easily repair or replace worn or damaged rails.

9. A skateboard/ski combination according to claim 1 further including a leash and cuff assembly that attaches the skateboard/ski combination to the rider.

10. A skateboard/ski combination according to claim 1 wherein said skis are constructed of plastic.

11. A skateboard/ski combination according to claim 1 wherein said skis are constructed of metal.

12. A skateboard/ski combination according to claim 1 wherein said skis are constructed of a composite material.

* * * * *